US007252918B2

(12) United States Patent
Nakamura et al.

(10) Patent No.: US 7,252,918 B2
(45) **Date of Patent: *Aug. 7, 2007**

(54) HOT-ROLLER FIXING TONER FOR DEVELOPING ELECTROSTATICALLY CHARGED IMAGES

(75) Inventors: Toru Nakamura, Abiko (JP); Toshimi Nishioka, Suita (JP); Takuya Hoga, Urawa (JP); Nobuyuki Kurokawa, Tokyo (JP); Junichi Fukuzawa, Yokohama (JP); Horst-Tore Land, Hofheim (DE); Fredy Helmer-Metzmann, Essenheim (DE)

(73) Assignee: Ticona GmbH (DE)

( * ) Notice: Subject to any disclaimer, the term of this patent is extended or adjusted under 35 U.S.C. 154(b) by 261 days.

This patent is subject to a terminal disclaimer.

(21) Appl. No.: 09/000,330

(22) PCT Filed: Jul. 29, 1996

(86) PCT No.: PCT/JP96/02133

§ 371 (c)(1),
(2), (4) Date: May 20, 1998

(87) PCT Pub. No.: WO97/05529

PCT Pub. Date: Feb. 13, 1997

(65) Prior Publication Data

US 2002/0025485 A1 Feb. 28, 2002

(30) Foreign Application Priority Data

Aug. 2, 1995 (JP) ..... 7-216751
Dec. 29, 1995 (JP) ..... 7-354063

(51) Int. Cl.
*G03G 9/087* (2006.01)

(52) U.S. Cl. ..... 430/109.3; 430/111.4

(58) Field of Classification Search ..... 430/109, 430/110, 111, 109.3, 111.4, 108.8, 114
See application file for complete search history.

(56) References Cited

U.S. PATENT DOCUMENTS

| | | | | |
|---|---|---|---|---|
| 3,922,256 | A * | 11/1975 | Locke et al. | 525/359.5 |
| 5,039,766 | A * | 8/1991 | Sasaki et al. | 526/161 |
| 5,106,715 | A | 4/1992 | Matsumura et al. | 430/110 |
| 5,179,156 | A * | 1/1993 | Takao et al. | 524/518 |
| 5,179,171 | A * | 1/1993 | Minami et al. | 525/288 |
| 5,292,609 | A * | 3/1994 | Yoshikawa et al. | 430/108.8 |
| 5,324,616 | A * | 6/1994 | Sacripante et al. | 430/109 |
| 5,650,254 | A * | 7/1997 | Eguchi et al. | 430/110 |
| 5,717,039 | A * | 2/1998 | Cusumano et al. | 525/340 |
| 5,741,617 | A * | 4/1998 | Inaba et al. | 430/110 |
| 5,759,469 | A * | 6/1998 | Asanuma et al. | 264/235 |
| 5,817,843 | A * | 10/1998 | Masuda et al. | 430/32 |

FOREIGN PATENT DOCUMENTS

| | | | |
|---|---|---|---|
| JP | 58-149060 | * | 9/1983 |
| JP | 63-191817 | * | 8/1988 |
| JP | 2-184864 | * | 7/1990 |
| JP | 06-27714 | | 2/1994 |

OTHER PUBLICATIONS

Derwent Abstract ACC-No. 1983—786559 of JP 58-149060 (Pub Sep. 1983).*

Derwent Abstract ACC-No. 1990—264534 of JP 02-184864 (Pub Jul. 1990).*

Patent & Trademark Office English-Language Translation of JP 63-191817 (Pub Aug. 9, 1988).*

Diamond, A.S. ed. *Handbook of Imaging Materials*, Marcel Dekker, Inc, NY (1991) , p. 169.*

Grant, R. et al. ed. *Grant & Hackh's Chemical Dictionary*, Fifth Edition, McGraw-Hill Book Company, NY (1987), p. 621.*

Caplus Abstract AN 1983: 603584 of JP 58-149060 (Pub Sep. 1983).*

Patent & Trademark Office English-Language Translation of Japanese Patent 02-184864 (Pub Jul. 1990).*

Patent & Trademark Office English-Language Translation of Japanese Patent 58-149060 (Pub Jun. 1993).*

Grant, R. et al. eds, Grant & Hackh's Chemical Dictionary, Fifth Edition, McGraw-Hill Book Company, NY (1987), p. 13.*

Grant, R. et al., eds, *Grant & Hackh's Chemical Dictionary*, 5th Edition, McGraw-Hill Co, NY (1987), p. 22.*

Neufeldt, V., et al, eds, Third College Edition, *Webster's New World Dictionary*, Simon & Schuster, Inc. NY (1988), p. 1044.*

*Aldrich Catalog* (1994), Aldrich Chemical Co, Inc., p. 1063.*

Welan, T. *Polymer Technology Dictionary*, Chapman & Hall, NY (1994), p. 487.*

(Continued)

*Primary Examiner*—Janis L. Dote
(74) *Attorney, Agent, or Firm*—Connolly Bove Lodge & Hutz LLP

(57) ABSTRACT

This invention relates to a toner for developing an electrostatically charged image of a heat roller type copier or printer, the toner consisting essentially of a binder resin, a colorant and a charge control agent, in which the binder resin at least includes a polyolefin resin having a cyclic structure, and a polyolefin resin of a cyclic structure having an intrinsic viscosity (i.v.) of 0.25 dl/g or more, a heat distortion temperature (HDT) by DIN53461-B of 70° C. or higher, and a number average molecular weight of 7,500 or more and a weight average molecular weight of 15,000 or more, as measured by GPC, is contained in a proportion of less than 50% by weight based on the entire binder resin. The toner for developing an electrostatically charged image according to the invention is excellent in fixability, light transmission, and anti-toner spent properties, giving a sharp, high quality image, can be applied to any of a dry one-component magnetic toner, a dry one-component nonmagnetic toner, a dry two-component toner and a liquid toner, and exhibits marked effects particularly when used in a color toner.

1 Claim, No Drawings

OTHER PUBLICATIONS

Grant, R. et al., ed: *Grant & Hackh's Chemical Dictionary*, Fifth Edition, McGraw-Hill Book Co., NY (1987), p. 582.*
*Kirk-Othmer Encyclopedia of Chemical Technology*, Fourth Edition, vol. 13, John Wiley & Sons, NY (1995), pp. 717-719.*
Patent Abstracts of Japan, vol. 7, No. 270 (p. 240), Dec. 2, 1983, of JP 58-149060 A.
Patent Abstracts of Japan, vol. 14, No. 465 (p. 114), Oct. 9, 1990, of JP 02-184864 A.

* cited by examiner

HOT-ROLLER FIXING TONER FOR DEVELOPING ELECTROSTATICALLY CHARGED IMAGES

TECHNICAL FIELD

The present invention relates to a toner for developing an electrostatically charged image of a heat roller type copier or printer. More specifically, this invention relates to a dry one-component magnetic toner, a dry one-component nonmagnetic toner, a dry two-component toner or a liquid toner which, when fixed, is excellent in anti-spent toner effect, and can form a well fixed, highly transparent, sharp image.

BACKGROUND ART

Heat roller fixing type electrostatically charged image developing copiers and printers are gaining popularity because of widespread office automation. With this background, demand is growing for high grade or sharp copied or printed images which are highly light transmissive and well fixed. General formulations for toners in heat roller fixing type electrostatically charged image developing copiers and printers are shown in Table 1. One of the main factors for improving the sharpness, light transmission and strength of fixing of the image is a binder resin, a chief component of the toner. That is, a heat roller fixing type electrostatically charged image developing copier or printer feeds a toner to an electrostatically charged image on a latent image carrier to obtain a visible image, then transfers the resulting toner image to a plain paper or an OHP film, and fixes the transferred image. Currently, styrene-acrylate resin and polyester resin are widely used as binder resins. With the former resin, however, the light transmission and clarity of the resulting toner are not fully satisfactory, resulting in difficulty in obtaining a high grade image. The latter resin, on the other hand, imparts sufficient light transmission, but the resin is yellowish in color, thus decreasing clarity.

TABLE 1

(Unit: wt. %)

| | Binder resin | Coloring agent | Charge control agent | Functioning agent | Magnetic powder | Solvent |
|---|---|---|---|---|---|---|
| Dry two component system | 50–100 | 0–20 | 0–10 | 0–20 | — | — |
| Dry nonmagnetic one component system | 50–100 | 0–20 | 0–10 | 0–20 | — | — |
| Dry magnetic one component system | 0–100 | 0–20 | 0–10 | 0–20 | 0–60 | — |
| Liquid toner | 15–50 | 0–10 | 0–5 | 0–10 | — | 50–70 |

The present invention has been accomplished in the light of the aforementioned problems. The object of this invention is to provide a toner in a dry two-component toner developer, a dry nonmagnetic one-component toner developer, a dry magnetic one-component toner developer, and a liquid toner developer which toner gives a higher grade copy image, namely, an image excellent in strength of fixing, light transmission and sharpness, in a heat roller fixing type electrostatically charged image developing copier or printer.

DISCLOSURE OF THE INVENTION

A first aspect of the present invention is to provide a toner for developing an electrostatically charged image of a heat roller type copier or printer, the toner consisting essentially of a binder resin, a colorant and a charge control agent, wherein the binder resin at least includes a polyolefin resin having a cyclic structure, and a polyolefin resin of a cyclic structure having an intrinsic viscosity (i.v.) of 0.25 dl/g or more, a heat distortion temperature (HDT) by DIN53461-B of 70° C. or higher, and a number average molecular weight of 7,500 or more and a weight average molecular weight of 15,000 or more, as measured by GPC, is contained in a proportion of less than 50% by weight based on the entire binder resin.

A second aspect of the invention is to provide the toner for developing an electrostatically charged image according the first aspect of the invention, in which the binder resin consists of 1 to 100 parts by weight of a polyolefin resin having a cyclic structure, and 0 to 99 parts by weight of at least one resin selected from polyester resins, epoxy resins, polyolefin resins, vinyl acetate resins, vinyl acetate copolymer resins, styrene-acrylate resins, and other acrylate resins.

A third aspect of the invention is to provide the toner for developing an electrostatically charged image according the first or second aspect of the invention, in which the polyolefin resin having a cyclic structure has at least one functional group selected from a carboxyl group, a hydroxyl group and an amino group.

A fourth aspect of the invention is to provide the toner for developing an electrostatically charged image according the first, second or third aspect of the invention, in which the polyolefin resin having a cyclic structure is an ionomer, or has a diene-crosslinked structure.

To solve the problems, we, the inventors, have worked out a measure involving the use of a colorless, highly transparent resin. Examples of such a resin are polycarbonates, polyacrylates, polymethacrylates and polystyrenes. These resins, however, are known to be unsatisfactory in terms of the properties required of binder resins, such as fixing strength and heat response characteristic, and to be questionable when used as binder resins. We have conducted extensive studies to correct these drawbacks, and have found that a toner providing a high grade image can be produced by using a colorless, transparent, highly light transmissive polyolefin resin having a cyclic structure, the polyolefin resin containing less than 50% by weight of a high-viscosity resin based on the entire binder resin. This finding has led us to accomplish the present invention. A toner using as a binder resin a polyolefin resin of a cyclic structure satisfying these characteristics is excellent in fixability, heat response characteristic, and light transmission, achieves a high grade, sharp image, and when used as a color toner, can exhibit its features.

The present invention will now be described in detail.

The toner for developing an electrostatically charged image of a heat roller type copier or printer according to the present invention consists essentially of a binder resin, in which the binder resin at least includes a polyolefin resin having a cyclic structure, and a polyolefin resin of a cyclic structure having an intrinsic viscosity (i.v.) of 0.25 dl/g or more, a heat distortion temperature (HDT) by DIN53461-B of 70° C. or higher, and a number average molecular weight of 7,500 or more and a weight average molecular weight of 15,000 or more, as measured by GPC, is contained in a proportion of less than 50% by weight based on the entire binder resin.

The polyolefin resin having a cyclic structure used herein is, for example, a copolymer of an alpha olefin, such as ethylene, propylene or butylene, with an alicyclic compound having a double bond, such as cyclohexene or norbornene, which copolymer is colorless and transparent, and has high light transmittance. This polyolefin having a cyclic structure is a polymer obtained, for instance, by a polymerization method using a metallocene catalyst or a Ziegler catalyst.

Preferred as the colorless, transparent, highly light-transmissive polyolefin of a cyclic structure used in the present invention are a low-viscosity resin having a number average molecular weight of 1,000 to 7,500, preferably 3,000 to 7,500, and a weight average molecular weight of 1,000 to 15,000, preferably 4,000 to 15,000, as measured by GPC, an intrinsic viscosity (i.v.) of less than 0.25 dl/g, and a heat distortion temperature (HDT) by DIN53461-B of lower than 70° C., and a high-viscosity resin having a number average molecular weight of 7,500 or more, preferably 7,500 to 50,000, and a weight average molecular weight of 15,000 or more, preferably 15,000 to 100,000, as measured by GPC, an i.v. of 0.25 dl/g or more, and an HDT of 70° C. or higher.

The low-viscosity polyolefin having a cyclic structure has the above-mentioned number average molecular weight Mn, weight average molecular weight Mw, intrinsic viscosity (i.v.) and heat distortion temperature (HDT). The Mw/Mn ratio, used as a measure of the degree of dispersion of molecular weight distribution, is as small as from 1 to 2.5, namely, a nearly monodisperse state. Thus, a toner having a quick heat response and a high fixing strength, properties required of a toner, can be realized. This polyolefin resin having a cyclic structure according to the present invention is characterized by the following facts: To T745 with a number average molecular weight of 4,000 to be shown later in Table 2, for example, there was added 5% of the azo pigment Permanent Rubin F6B (Hoechst). The mixture was thoroughly dispersed with a kneader, then formed into a sheet by means of a press, and measured for light transmittance using the Macbeth densitometer RD914 (filter SPI red) with visible light of 624 nm. Its light transmittance was 12.0%. Whereas styrene-acrylate resin showed light transmittance of 7.0%, and polyester resin, 15.5%. Hence, the polyolefin resin having a cyclic structure was confirmed to have high transparency even in a pigment-dispersed system, and to be usable for a color toner as is polyester resin. Measurement by DSC has shown this polyolefin resin to require very low heat of fusion. Thus, this resin can be expected to markedly reduce energy consumption for fixing.

The high-viscosity polyolefin resin having a cyclic structure has the aforesaid properties. Compared with the same resin with a low viscosity, therefore, this resin imparts structural viscosity to the toner, thereby improving offset preventing effect and adhesion to a material to be copied on, such as a paper or film. The low-viscosity polyolefin resin having a cyclic structure, on the other hand, improves the melt flowability of the toner, and satisfies toner characteristics requiring instantaneous melting and solidifying behaviors.

If the amount of the high-viscosity resin used is 50% or more, however, the uniform kneadability of the resin-pigment mixture extremely will decline, deteriorating toner performance. As a result, the toner will become poor in fixability and heat response characteristic, thus resulting in the failure to obtain a high grade, sharp image.

In the present invention, a toner using a binder resin comprising a mixture of other resin with the polyolefin resin having a cyclic structure, which satisfies the foregoing characteristics, also achieves an image of a high grade, i.e., with high fixing strength and sharpness. In this case, it is preferred that the proportions of the polyolefin resin having a cyclic structure and the other resin in the binder resin are to be 1 to 100, preferably 20 to 90, more preferably 50 to 90 parts by weight of the former, and 0 to 99, preferably 10 to 80, more preferably 10 to 50 parts by weight of the latter. If the amount of the former resin is less than 1 part by weight, it becomes difficult to obtain a high grade image.

If a carboxyl group is introduced into the polyolefin resin having a cyclic structure by the melt air oxidation method or modification with maleic anhydride, its compatibility with the other resin and the dispersability of the pigment can be improved. The same improvement can be achieved by introducing a hydroxyl group or an amino group by a known method.

Furthermore, fixability can be improved by copolymerizing the polyolefin resin having a cyclic structure with a diene monomer such as norbornadiene or cyclohexadiene, or by introducing a crosslinking structure into the polyolefin resin of a cyclic structure, which has a carboxyl group introduced therein, by adding a metal such as zinc, copper or calcium.

The toner for developing an electrostatically charged image of a heat roller type copier or printer according to the present invention can be obtained by adding a colorant, a charge control agent, and if desired, a functioning agent, and other additives to the aforementioned binder resin, and performing known methods such as kneading, grinding and sifting. If desired, a flowing agent may be further added.

The colorant may be a known one, such as carbon black, diazo yellow, phthalocyanine blue, quinacridone, carmine 6B, monoazo red or perylene.

Examples of the charge control agent are known ones such as Nigrosine dyes, fatty acid modified Nigrosine dyes, metallized Nigrosine dyes, metallized fatty acid modified Nigrosine dyes, chromium complexes of 3,5-di-tert-butylsalicylic acid, quaternary ammonium salts, triphenylmethane dyes, and azochromium complexes.

If desired, a known functioning agent, preferably, wax with a melting point of 60 to 170° C., may be added to the toner of the present invention in order to enhance the offset preventing properties during fixing by a heat roller. Examples of the wax with this melting point are carnauba wax, montan wax, and glycerol monostearate.

To the toner of the present invention, there may be further added a flowing agent such as colloidal silica, aluminum oxide or titanium oxide, and a lubricant comprising a fatty acid metal salt such as barium stearate, calcium stearate or barium laurate.

The toner of the present invention may be used as a toner for one component developers or two component developers. Moreover, the toner of the present invention may be used as a one component magnetic toner by incorporating a magnetic powder, or may be used as a full color toner.

The present invention will be described in more detail by reference to Examples and Comparative Examples.

<Toner Preparation Method I>

Dry Nonmagnetic one Component System and Dry two Component System:

Five % by weight of a charge control agent (Copy Charge NX, Hoechst), 2.5% by weight of wax (Hoechst Wax E, Hoechst), 0.5% by weight of aerosol silica (HDK-H2000, Wacker Chemie), 5% by weight of magenta pigment (Permanent Rubin F6B, Hoechst), and 87% by weight of a binder resin were mixed, and melt kneaded at 130° C. by a two roll mill. Then, the mixture was cooled down to solidification, and crushed, followed by powderizing the particles using a jet mill. The resulting fine particles were sieved or sifted to select particles with an average particle diameter of about 10 micrometers, thereby preparing a toner.

<Toner Preparation Method II>

Dry Magnetic one Component System:

Forty % by weight of a magnetic powder (BL100, Titanium Industry), 5% by weight of a charge control agent (Copy Charge NX, Hoechst), 2.5% by weight of wax (Hostastat FE-2, Hoechst), 0.5% by weight of aerosol silica (HDK-H2000, Wacker Chemie), 2% by weight of calcium carbonate (Shiraishi Calcium), and 50% by weight of a binder resin were mixed, and melt kneaded at 150° C. by a two roll mill. Then, the mixture was cooled down to soidification, and crushed, followed by powderizing the particles using a jet mill. The resulting fine particles were sifted to select particles with an average particle diameter of about 10 micrometers, thereby preparing a toner.

<Toner Preparation Method III>

Liquid Toner:

Forty % by weight of a mixture consisting of 1 part by weight of carbon black (MA-7, Mitsubishi Kagaku) as a colorant, 0.5 part by weight of a charge control agent (Reflect Blue R51, Hoechst), and 98.5 parts by weight of a binder resin was mixed with 60% by weight of an electrolytic solution (Isopar H, Exxon). The mixture was kneaded with a sand mill to prepare a toner.

Examples 1 to 27 and Comparative Examples 1 to 6

Using the toner preparation methods and binder resins shown in Table 2 below, toners of Examples 1 to 27 and Comparative Examples 1 through 6 were produced. Table 3 presents the fundamental properties of the polyolefin resins having a cyclic structure used, and the trade names of other resins used.

TABLE 2-1

| Ex. or Comp. Ex. No. | Method of Toner preparation | Formulation of binder resin: Sample No. | wt. % | Sample No. | wt. % |
|---|---|---|---|---|---|
| Ex. | | | | | |
| 1 | I | 1 | 87 | — | — |
| 2 | I | 1 | 58 | 2 | 29 |
| 3 | I | 1 | 58 | 7 | 29 |
| 4 | I | 3 | 87 | — | — |
| 5 | I | 3 | 58 | 7 | 29 |
| 6 | I | 5 | 87 | — | — |
| 7 | I | 5 | 58 | 7 | 29 |
| 8 | II | 1 | 50 | — | — |
| 9 | II | 1 | 30 | 2 | 20 |
| 10 | II | 1 | 30 | 7 | 20 |
| 11 | II | 1 | 30 | 8 | 20 |
| 12 | II | 3 | 50 | — | — |
| 13 | II | 3 | 30 | 7 | 20 |
| 14 | II | 3 | 30 | 8 | 20 |
| 15 | II | 5 | 50 | — | — |
| 16 | II | 5 | 30 | 7 | 20 |
| 17 | II | 5 | 30 | 8 | 20 |
| 18 | III | 1 | 39.4 | — | — |
| 19 | III | 1 | 24 | 2 | 15.4 |
| 20 | III | 1 | 24 | 7 | 15.4 |
| 21 | III | 1 | 24 | 8 | 15.4 |
| 22 | III | 3 | 39.4 | — | — |
| 23 | III | 3 | 24 | 7 | 15.4 |
| 24 | III | 3 | 24 | 8 | 15.4 |
| 25 | III | 5 | 39.4 | — | — |
| 26 | III | 5 | 24 | 7 | 15.4 |
| 27 | III | 5 | 24 | 8 | 15.4 |
| Comp. Ex. | | | | | |
| 1 | I | 7 | 87 | — | — |
| 2 | I | 8 | 87 | — | — |
| 3 | II | 7 | 50 | — | — |
| 4 | II | 8 | 50 | — | — |
| 5 | III | 7 | 39.4 | — | — |
| 6 | III | 8 | 39.4 | — | — |

TABLE 3

| Sample No. | Product | Mw | Mn | i.v. | HDT | D | Tg |
|---|---|---|---|---|---|---|---|
| 1 | T745 | 7000 | 3800 | 0.19 | <70 | 1.8 | 68 |
| 2 | S-8007 | 70000 | 35000 | 0.8 | ≧70 | 2.0 | 80 |
| 3 | T-745-MO | 6800 | 3400 | <0.25 | <70 | 2.0 | 78 |
| 5 | T-745-CL | 12000 | 3400 | <0.25 | <70 | 3.5 | 76 |
| 7 | Tafton NE2155 Polyester resin of Kao Corp. | | | | | | |
| 8 | MC100 Styrene-acrylate resin of Nihon Carbide | | | | | | |

<Evaluations>

The toners prepared by the above toner preparation method I or II were each placed in a commercially available electrophotographic copier (PC100, Canon Inc.), and subjected to performance test. Then, the toners prepared by the toner preparation method III were each placed in a commercially available electrophotographic copier (FT400i, Ricoh Co., Ltd.), and subjected to performance test. The results are shown in Table 4.

TABLE 4-1

| | Fixability 10 copies per min | Image sharpness: Thin line resolving power | Image sharpness: Gray scale | Light transmission 624 nm | Anti-toner spent Properties |
|---|---|---|---|---|---|
| Ex. 1 | ○ | ○ | ○ | ○ | ○ |
| Ex. 2 | ○ | ○ | ○ | ○ | ○ |
| Ex. 3 | ○ | Δ | Δ | Δ | Δ |
| Ex. 4 | ○ | ○ | ○ | ○ | ○ |
| Ex. 5 | ○ | ○ | ○ | ○ | ○ |
| Ex. 6 | ○ | ○ | ○ | ○ | ○ |
| Ex. 7 | ○ | Δ | Δ | Δ | Δ |
| Ex. 8 | ○ | ○ | ○ | — | ○ |
| Ex. 9 | ○ | ○ | ○ | — | ○ |
| Ex. 10 | ○ | ○ | ○ | — | Δ |
| Ex. 11 | ○ | ○ | ○ | — | Δ |
| Ex. 12 | ○ | ○ | ○ | — | ○ |
| Ex. 13 | ○ | ○ | ○ | — | ○ |
| Ex. 14 | ○ | ○ | ○ | — | ○ |
| Ex. 15 | ○ | ○ | ○ | — | ○ |
| Ex. 16 | ○ | ○ | ○ | — | Δ |
| Ex. 17 | ○ | ○ | ○ | — | Δ |
| Ex. 18 | ○ | ○ | ○ | — | ○ |
| Ex. 19 | ○ | ○ | ○ | — | ○ |
| Ex. 20 | ○ | ○ | ○ | — | — |
| Ex. 21 | ○ | ○ | ○ | — | — |
| Ex. 22 | ○ | ○ | ○ | — | — |
| Ex. 23 | ○ | ○ | ○ | — | — |
| Ex. 24 | ○ | ○ | ○ | — | — |
| Ex. 25 | ○ | ○ | ○ | — | — |
| Ex. 26 | ○ | ○ | ○ | — | — |
| Ex. 27 | ○ | ○ | ○ | — | — |
| Comp. Ex. 1 | X | Δ | Δ | ○ | X |
| Comp. Ex. 2 | X | X | X | X | X |
| Comp. Ex. 3 | X | ○ | ○ | — | X |
| Comp. Ex. 4 | X | ○ | ○ | — | X |
| Comp. Ex. 5 | X | ○ | ○ | — | X |
| Comp. Ex. 6 | X | ○ | ○ | — | X |

Evaluation Methods and Evaluation Criteria

1) Fixability

The toners prepared with the respective formulations were each used for copying onto recycled papers at a copying rate of 10 copies/min at a fixing temperature of 110 to 140° C., with the fixing temperature for each copying cycle being raised by 10° C. The resulting copy samples were rubbed 10 times with an eraser by using an abrasion tester of Southerland. The load during the test was 40 g/cm$^2$. The tested samples were measured for the printing density using a Macbeth reflection densitometer. The symbol X was assigned when even one of the measured values at the respective temperatures was less than 65%. The symbol Δ was assigned when the measured values at the respective temperatures were 65% or more but less than 75%. The symbol ○ was assigned when the measured values at the respective temperatures were 75% or more.

2) Image Sharpness

The toners prepared with the respective formulations were each used for copying onto recycled papers. The resulting samples were checked against sample images of Data Quest. The thin line resolving power and gray scale of the copy image were used as bases for evaluation. The symbol X was assigned when the thin line resolving power was 200 dots/inch or less, Δ for a thin line resolving power of 201 to 300 dots/inch, and ○ for a thin line resolving power of 301 dots/inch or more. The ratio of the reflection density of the copy image to that of the reflection density of the sample image, at each step of the gray scale, was evaluated as X when less than 65%, Δ when 65% or more but less than 75%, and ○ when 75% or more.

3) Light Transmission

The magenta-colored toners prepared with the formulations of the Examples and the Comparative Examples were each used to produce sheet-shaped samples 100 micrometers thick. The light transmission of each sheet sample was measured using an optical filter having a peak at 624 nm. The light transmittance at 624 nm was evaluated as X when less than 8%, Δ when 8% or more but less than 11%, and ○ when 11% or more.

4) Anti-toner Spent Properties

The toner described in each of the Examples and the Comparative Examples and a ferrite carrier of Powdertech were put in predetermined amounts into a developer box. After the mixture was stirred and triboelectrically treated for 1 week, 5 g of the toner-deposited carrier was weighed. This carrier was put in water with soap to remove the toner electrostatically adhering to the surface. Only the carrier magnetic powder was collected using a magnet. The magnetic powder was immersed in acetone to dissolve and remove the spent toner fused to the surface. A change in the weight after immersion compared with the weight before immersion was evaluated as ○ when less than 0.2%, Δ when 0.2 or more but less than 0.5%, and X when 0.5% or more.

The toner for developing an electrostatically charged image of a heat roller type copier or printer according to the present invention contains a binder resin at least including a polyolefin resin having a cyclic structure, in which a high-viscosity polyolefin resin having a cyclic structure is contained in a proportion of less than 50% by weight based on the entire binder resin. Thus, the toner is excellent in fixability, light transmission, and anti-toner spent properties, gives a high quality sharp image, and exhibits its features particularly when used in a color toner.

What is claimed is:

1. A toner for developing an electrostatically charged copier or printer image, the toner consisting essentially of:

a) a binder resin;

b) a colorant which is carbon black, diazo yellow, phthalocyanine blue, quinacridone, carmine 6B, monoazo red or perylene; and c) a charge control agent, wherein the binder resin includes a polyolefin resin having a cyclic structure, wherein the polyolefin resin is a copolymer derived from an alpha-olefin, an alicyclic compound having one double bond and, optionally, a diene monomer, and wherein the electrostatically charged copier or printer image is fixed by the action of a heated roller and said polyolefin resin having a cyclic structure further comprising a carboxyl group is cross-linked by metal ions or dienes.

* * * * *